US009033725B2

(12) United States Patent
Fransen

(10) Patent No.: US 9,033,725 B2
(45) Date of Patent: May 19, 2015

(54) GG45 PLUG WITH HINGING LOAD BAR

(71) Applicant: Panduit Corp., Tinley Park, IL (US)

(72) Inventor: Robert E. Fransen, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 148 days.

(21) Appl. No.: 13/864,924

(22) Filed: Apr. 17, 2013

(65) Prior Publication Data

US 2013/0280962 A1 Oct. 24, 2013

Related U.S. Application Data

(60) Provisional application No. 61/635,669, filed on Apr. 19, 2012.

(51) Int. Cl.

| | |
|---|---|
| ***H01R 4/50*** | (2006.01) |
| ***H01R 13/625*** | (2006.01) |
| ***H01R 13/6461*** | (2011.01) |
| ***H01R 4/24*** | (2006.01) |
| ***H01R 13/50*** | (2006.01) |
| ***H01R 24/28*** | (2011.01) |
| ***H01R 24/64*** | (2011.01) |

(52) U.S. Cl.

CPC ..... *H01R 13/6461* (2013.01); *H01R 4/2433* (2013.01); *H01R 13/501* (2013.01); *H01R 24/28* (2013.01); *H01R 24/64* (2013.01)

(58) Field of Classification Search

USPC ..... 439/344, 367, 409, 410

See application file for complete search history.

(56) References Cited

U.S. PATENT DOCUMENTS

| | | | | |
|---|---|---|---|---|
| 5,372,513 | A | 12/1994 | Rodrigues et al. | |
| 5,571,035 | A | 11/1996 | Ferrill | |
| 6,238,246 | B1 | 5/2001 | Ferrill et al. | |
| 6,287,149 | B1 | 9/2001 | Elkhatib et al. | |
| 6,328,601 | B1 | 12/2001 | Yip et al. | |
| 6,358,091 | B1 | 3/2002 | Lo et al. | |
| 6,629,858 | B2 | 10/2003 | Lo et al. | |
| 6,682,363 | B1 | 1/2004 | Chang et al. | |
| 6,702,617 | B1 | 3/2004 | Clement et al. | |
| 6,811,445 | B2 | 11/2004 | Caveney et al. | |
| 7,220,149 | B2 | 5/2007 | Pharney | |
| 7,329,137 | B2 * | 2/2008 | Martin et al. | 439/344 |
| 7,413,464 | B1 | 8/2008 | Chen | |
| 7,435,142 | B1 | 10/2008 | Hsu | |
| 7,572,140 | B2 * | 8/2009 | Szelag et al. | 439/405 |
| 7,686,650 | B2 | 3/2010 | Belopolsky et al. | |
| 7,727,025 | B2 * | 6/2010 | Fogg et al. | 439/660 |
| 7,753,717 | B2 | 7/2010 | Belopolsky et al. | |
| 7,857,635 | B2 | 12/2010 | Goodrich et al. | |
| 7,918,684 | B2 | 4/2011 | Lu | |
| 7,972,150 | B1 | 7/2011 | Lin | |

(Continued)

FOREIGN PATENT DOCUMENTS

| | | | |
|---|---|---|---|
| EP | 1892801 | A1 | 2/2008 |
| WO | 2008071917 | A1 | 6/2008 |

*Primary Examiner* — Hae Moon Hyeon

(74) *Attorney, Agent, or Firm* — Christopher S. Clancy; Christopher K. Marlow; Yuri Astvatsaturov

(57) ABSTRACT

A communication plug is described. The communication plug can have a load bar, housing, and a divider. The load bar has a first half with first conductor receiving apertures and a second half with second conductor receiving apertures with a hinge connecting the first half and the second half. The load bar folds around the divider and then is inserted into the housing.

24 Claims, 11 Drawing Sheets

(56) References Cited

U.S. PATENT DOCUMENTS

| | | | | |
|---|---|---|---|---|
| 8,038,461 | B2 | 10/2011 | Hsu | |
| 8,070,506 | B2 * | 12/2011 | De Dios Martin et al. | 439/409 |
| 8,096,833 | B2 | 1/2012 | Tobey | |
| 8,192,224 | B2 * | 6/2012 | Schmidt et al. | 439/409 |
| 8,573,999 | B2 * | 11/2013 | Feldner et al. | 439/409 |
| 8,702,444 | B2 * | 4/2014 | Maranto et al. | 439/467 |
| 2007/0270044 | A1 | 11/2007 | Belopolsky et al. | |
| 2011/0212652 | A1 | 9/2011 | Schmidt et al. | |
| 2012/0088395 | A1 | 4/2012 | Feldner et al. | |

* cited by examiner

GG45 PLUG WITH HINGING LOAD BAR

CROSS REFERENCE TO RELATED APPLICATION

This application claims the benefit of U.S. Provisional Patent Application No. 61/635,669, filed Apr. 19, 2012 and is incorporated by reference in its entirety.

BACKGROUND OF THE INVENTION

With the steady increase of users adopting 10GBASE-T Ethernet for areas such as high performance computing (HPC), storage area networks (SANs), and cloud computing, there is a need for an even greater increase in data rates in the network backbone. The highest established data transmission rate for structured copper cabling is currently 10 Gigabits per second (Gps) running on Category 6A (CAT6A) cabling. Additionally, point-to-point copper cabling solutions can run through a 40 Gps Quad Small Form-factor Pluggable (QSFP) connector via twin-axial copper cable. Unfortunately the QSFP connectivity comes with multiple drawbacks where one of the deficiencies is the maximum distance of 7 meters while the lengths used for HPC can be up to 50 meters. Other drawbacks of QSFP connectivity are that it is not backwards compatible with RJ45 connectivity, and does not currently support structured cabling.

Because of the split pair (pair 3-6 as defined by ANSI/TIA-568-C.2) in RJ45 connectivity and because of current practical modulation techniques, RJ45 connectivity is not currently capable of reaching higher data rates beyond 10 Gps. One of the problems with RJ45 connectivity is the inability to mitigate near-end crosstalk (NEXT) at frequencies above 500 MHz (for example, 2 GHz) where the current materials and crosstalk compensation techniques are some of the limiting factors. Another issue with RJ45 connectivity is the high level of signal reflection due to the split pair geometry in the RJ45 plug which causes high loss in the data transmitted in the frequencies beyond 500 MHz. Because of the inability for the RJ45 interface to operate effectively at frequencies above 500 MHz, the International Electrotechnical Commission (IEC) developed the IEC 60603-7-7 and 60603-7-71 standard for Category 7 and 7A connectivity. This standard defines a new connector interface, commonly referred to as GG45, where the jack supports a bandwidth greater than 500 MHz (600 MHz for Category 7 and 1000 MHz for Category 7A), while also having backwards compatibility to accept an RJ45 plug. U.S. Provisional Patent Application No. 61/543,866, titled "Backward Compatible Connectivity for High Data Rate Applications", filed Oct. 6, 2011, which is herein incorporated by reference in its entirety, describes such a jack that is compliant with the IEC 60603-7-7 standard. The plug defined in the IEC 60603-7-7 standard differs from an RJ45 plug in that the four conductor pairs are separated into four quadrants, eliminating the 3-6 split pair that limits the bandwidth of the RJ45 solution.

DESCRIPTION OF THE INVENTION

In one embodiment, the present invention is a plug compliant with IEC 60603-7-7 (hereby referred to as GG45 plug) and has the ability to operate at frequencies above 500 MHz for use in higher data rates future applications (ex. 40GBASE-T).

Figure 1:
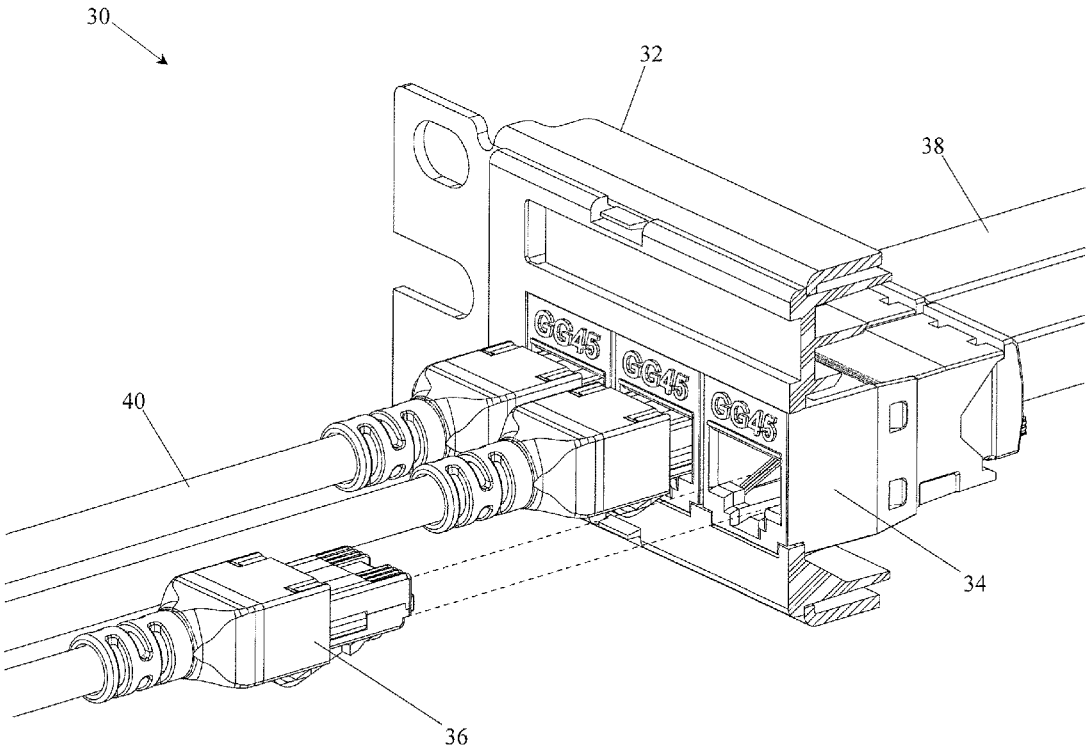
FIG. 1 is a perspective view of a communication system using a plug according to an embodiment of a present invention.

FIG. 1 illustrates a copper structured cabling communication system 30 which includes a patch panel 32 with GG45 jacks 34 and corresponding GG45 plugs 36. Respective cables 38 are terminated to GG45 jacks 34, and respective S/FTP cables 40 are terminated to GG45 plugs 36. Once a GG45 plug 36 mates with a GG45 jack 34 data can flow in both directions through these connectors.

Figure 2:
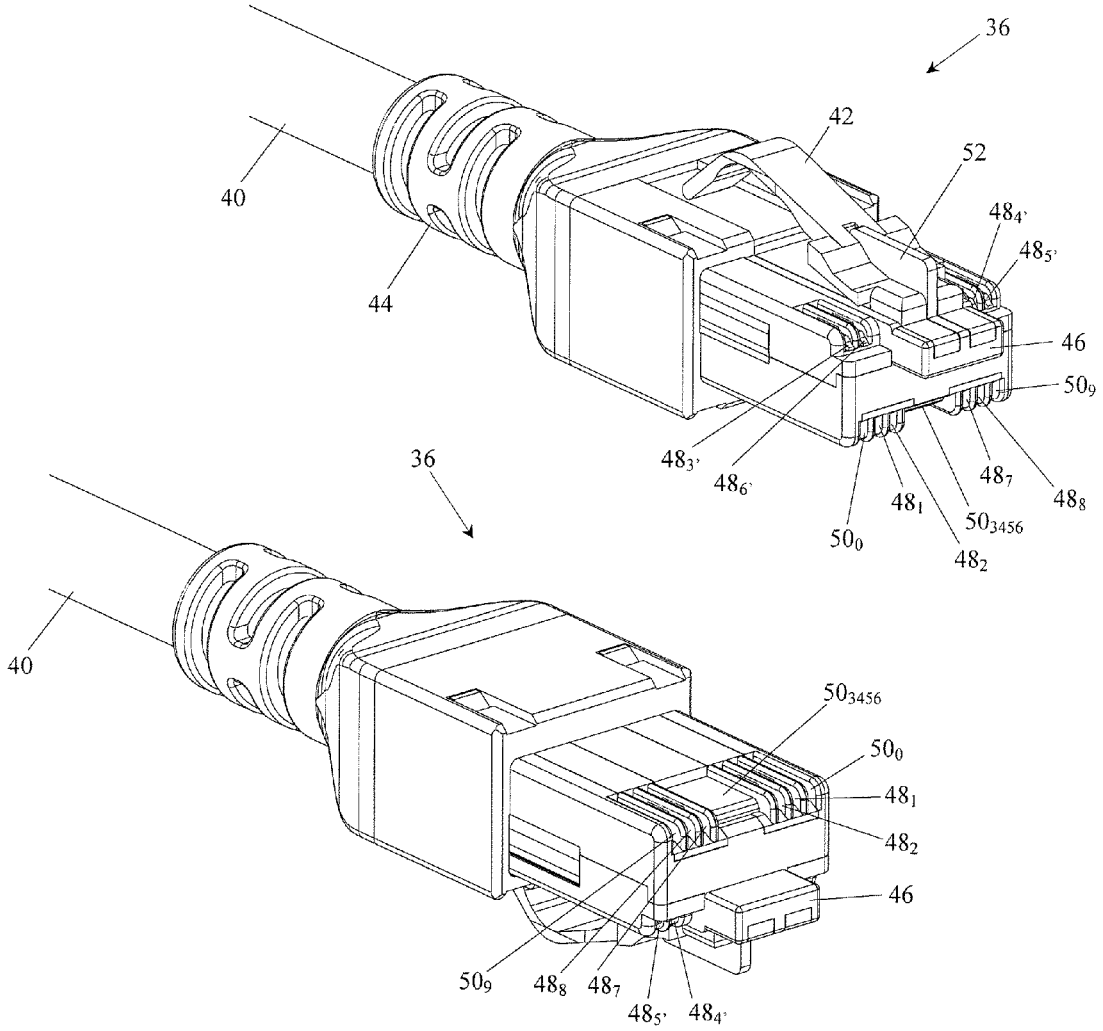
FIG. 2 includes top and bottom front isometric views of the plug of FIG. 1.

Referring now to FIG. 2, GG45 plug 36 can include a plug release latch 42 that engages and locks GG45 plug 36 to GG45 jack 34. Boot 44 can be used to constrain cable 40 so that it does not bend less than a minimum bend radius for S/FTP cable 40 exiting GG45 plug 36. Front nose element 46 is a feature defined by IEC 60603-7-7 and is used to toggle a switching mechanism inside of GG45 jack 34. A traditional RJ45 plug does not have a feature like front nose element 46 of GG45 plug 36. Therefore when an RJ45 plug is inserted into GG45 jack 34, the switching mechanism is not toggled. When GG45 plug 36 is inserted into GG45 jack 34, however, front nose element 46 toggles the switching mechanism so that GG45 jack 34 is converted to its alternate mode of operation capable of supporting frequencies above 500 MHz. U.S. Provisional Patent Application No. 61/543,866 contains more detail on an embodiment of a switching mechanism and two modes of operation for GG45 jack 34.

GG45 plug 36 contains eight transmission paths 48. The subscript numerals after 48 in FIG. 2 indicate the signal pin out as defined by IEC 60603-7-7. Grounding pads 50 are present to bond to unneeded plug interface contacts (PICs) of GG45 jack 34 and bring them to ground. Grounding pad $\mathbf{50}_{3456}$ grounds PICs 3, 4, 5, and 6 of GG45 jack 34 as these PICs are only used during RJ45 mode of operation and are unused at frequencies above 500 MHz. Additionally, grounding pads $\mathbf{50}_0$ and $\mathbf{50}_9$ are present to ground PICs 0 and 9 of GG45 jacks 34 should they exist. It may be advantageous to include PICs 0 and 9 in GG45 jack 34 in order to achieve as much of a balanced design as possible. For example, transmission paths $\mathbf{48}_7$ and $\mathbf{48}_8$ represent a transmission pair. When PIC 6 is grounded by grounding pad $50_{3456}$, transmission path $48_7$ has a ground running parallel adjacent in the form of PIC 6. If there is no grounded PIC 9 running parallel adjacent to transmission path $48_8$, then the system may become unbalanced. The same holds true for transmission paths $48_1$ and $48_2$. Therefore, in one embodiment, GG45 plug 36 can have grounding pads $50_0$ and $50_9$ as provisions for a highly balanced system that may extend into GG45 jack 34. GG45 plug 36 can also have dividing wall 52 which reduces crosstalk between signal transmission pair $48_{3'}$ and $48_{6'}$ and signal transmission pair $48_{4'}$ and $48_{5'}$.

Figure 3:
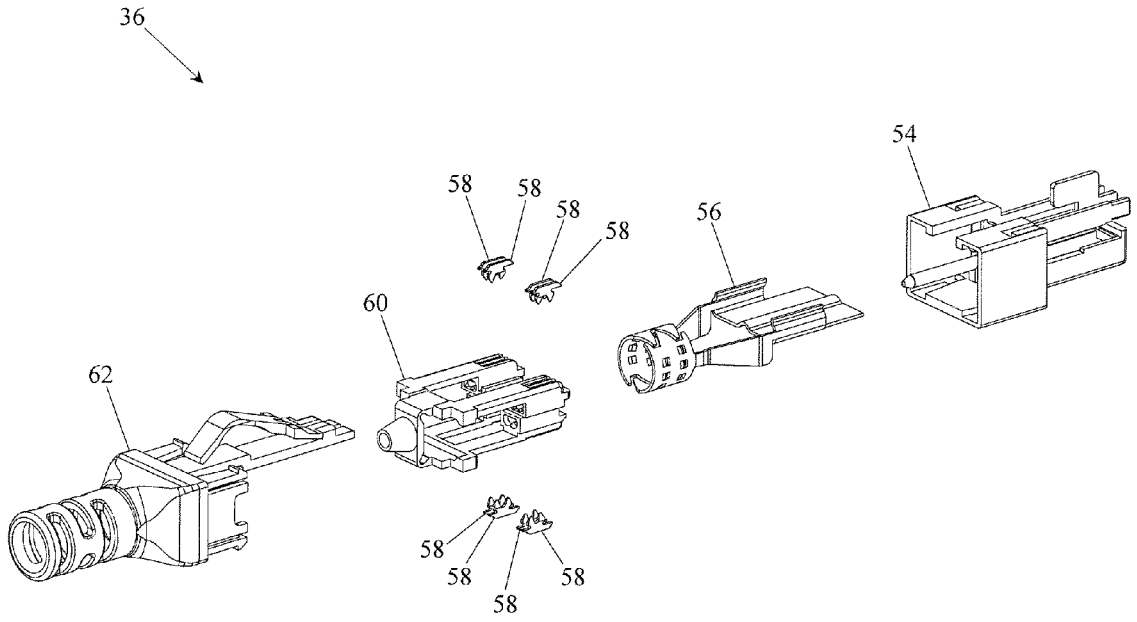
FIG. 3 is an exploded perspective view of the plug of FIG. 2.

Signal transmission paths for conductors 1, 2, 7, and 8 are in the same locations for both GG45 plug 36 and a standard RJ45 plug. Numerals with a prime, specifically 3', 4', 5', and 6', are unique to the GG45 interface and are not present in RJ45 plugs and jacks. An exploded view of GG45 plug 36 is shown in FIG. 3. GG45 plug 36 may contain plug housing 54 (which may be metal die cast for example), divider 56 (which may be a sheet metal part), eight plug insulation piercing contacts (IPCs) 58, hinging load bar 60, and plastic back housing 62.

Figure 4:
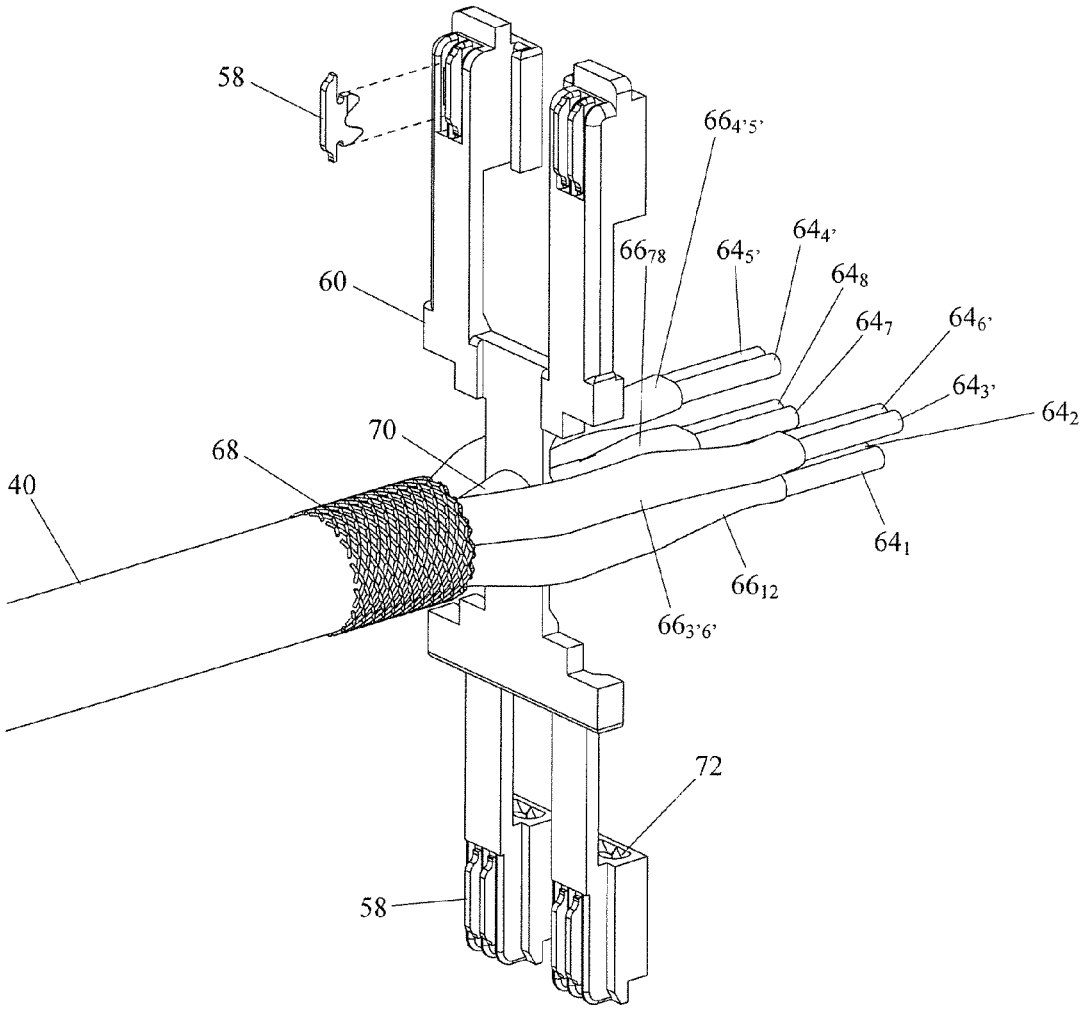
FIG. 4 is a perspective view showing the hinging load bar of the plug of FIG. 2 in an open position before the conductors of a twisted pair cable are inserted into their respective load bar holes.

To terminate S/FTP cable 40 to GG45 plug 36, S/FTP cable 40 must be prepped as shown in FIG. 4. Hinging load bar 60 can be molded in an open orientation. Plug contacts 58 can be stitched into hinging load bar 60 only so deep as to not fall out. Conductors 64 are arranged according to their signal transmission pin out as defined by IEC 60603-7-7 and cut to a prescribed length. Additionally, foil 66 that surrounds each signal transmission pair of conductors 64 must be trimmed as shown in FIG. 4. Braid 68 of shielded/foiled twisted pair (S/FTP) cable 40 is rolled back and trimmed to the appropriate length. Hinging load bar 60 can be positioned between the four pairs of conductors. Conical guide element 70 aids in the positioning of hinging load bar 60 relative to S/FTP cable 40.

Figure 5:
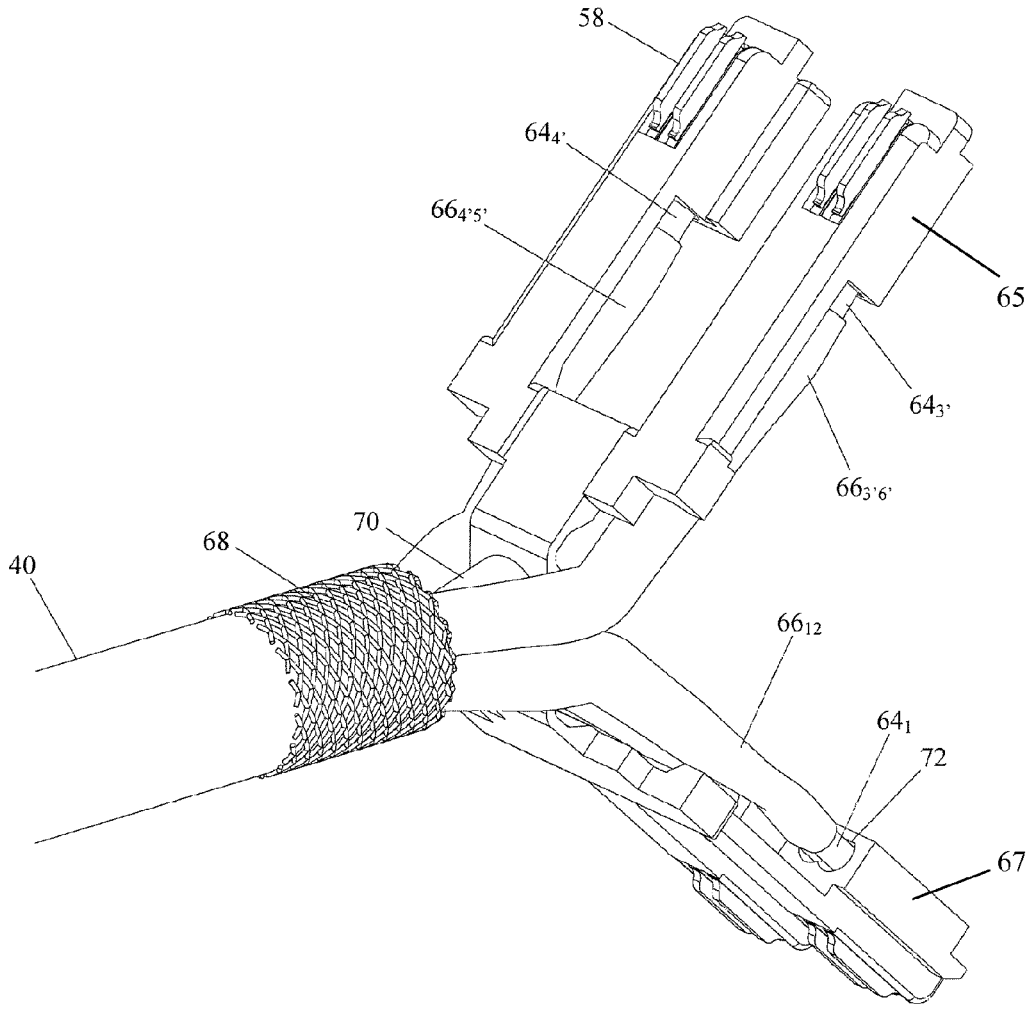
FIG. 5 is a perspective view showing the hinging load bar of FIG. 4 still in the open position but with the conductors of the cable inserted into their respective load bar holes.
Figure 6:
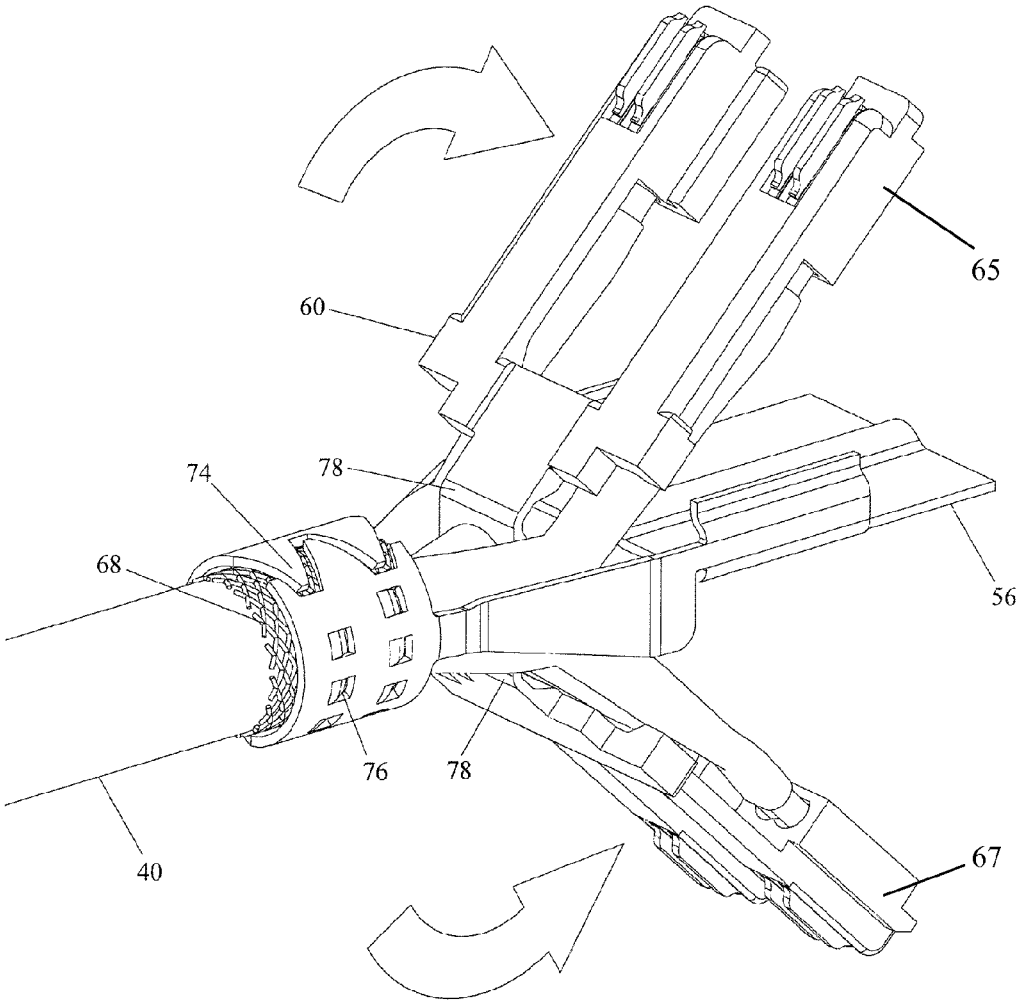
FIG. 6 is a perspective view of the sub-assembly of FIG. 5 collapsing around the metal divider.
Figure 7:
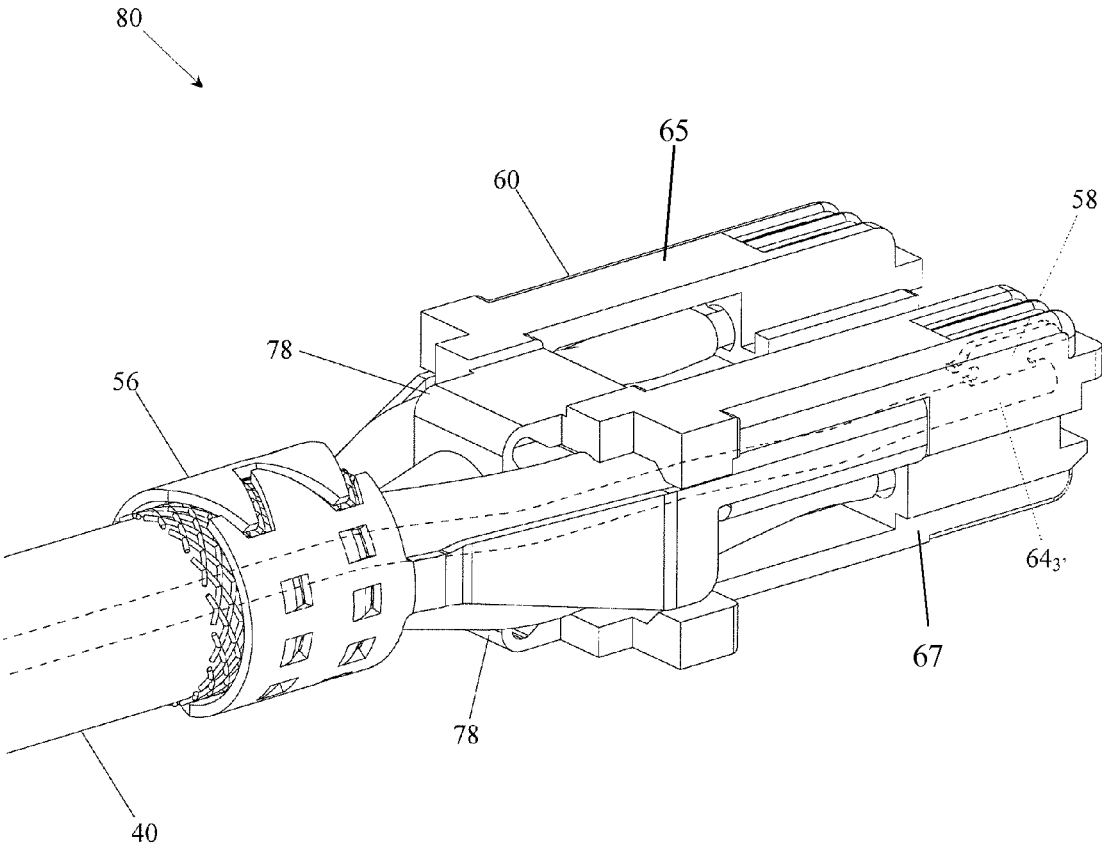
FIG. 7 is a perspective view of the sub-assembly of FIG. 6 with the conductors of the cable inserted into their respective holes of the hinging load bar and the hinging load bar collapsed around the metal divider.

With S/FTP cable 40 prepped and hinging load bar 60 together with its first half 65 and second half 67 in its proper position, each conductor 64 is inserted into its respective hole 72 as shown in FIG. 5. An advantage to molding hinging load bar 60 in an open orientation is that holes 72 are much more accessible than if hinging load bar 60 was molded closed. This advantage can result in reduced assembly time and lower standard cost. Divider 56 is then positioned between the top and bottom rows of conductor pairs as shown in FIG. 6. Divider 56 is used to provide isolation between the top and bottom signal pairs. It also bonds to braid 68 of S/FTP cable 40 to carry the ground throughout GG45 plug 36. Divider 56 contains overlapping flanges 74 that reduce long gaps in coverage thereby providing a 360° bond around braid 68. Shear form barbs 76 are present to bite into the braid and cable jacket of S/FTP cable 40, providing the necessary strain relief to pass applicable strain relief testing. FIG. 7 shows hinging load bar 60 with its first half 65 and second half 67 closed about hinges 78. At this time, contacts 58 are mechanically crimped to a distance that is in accordance with IEC 60603-7-7. The crimping operation can result in contacts 58 penetrating their respective conductor 64 such that contacts 58 make an electrical bond to the copper core of respective conductors 64.

Figure 8:
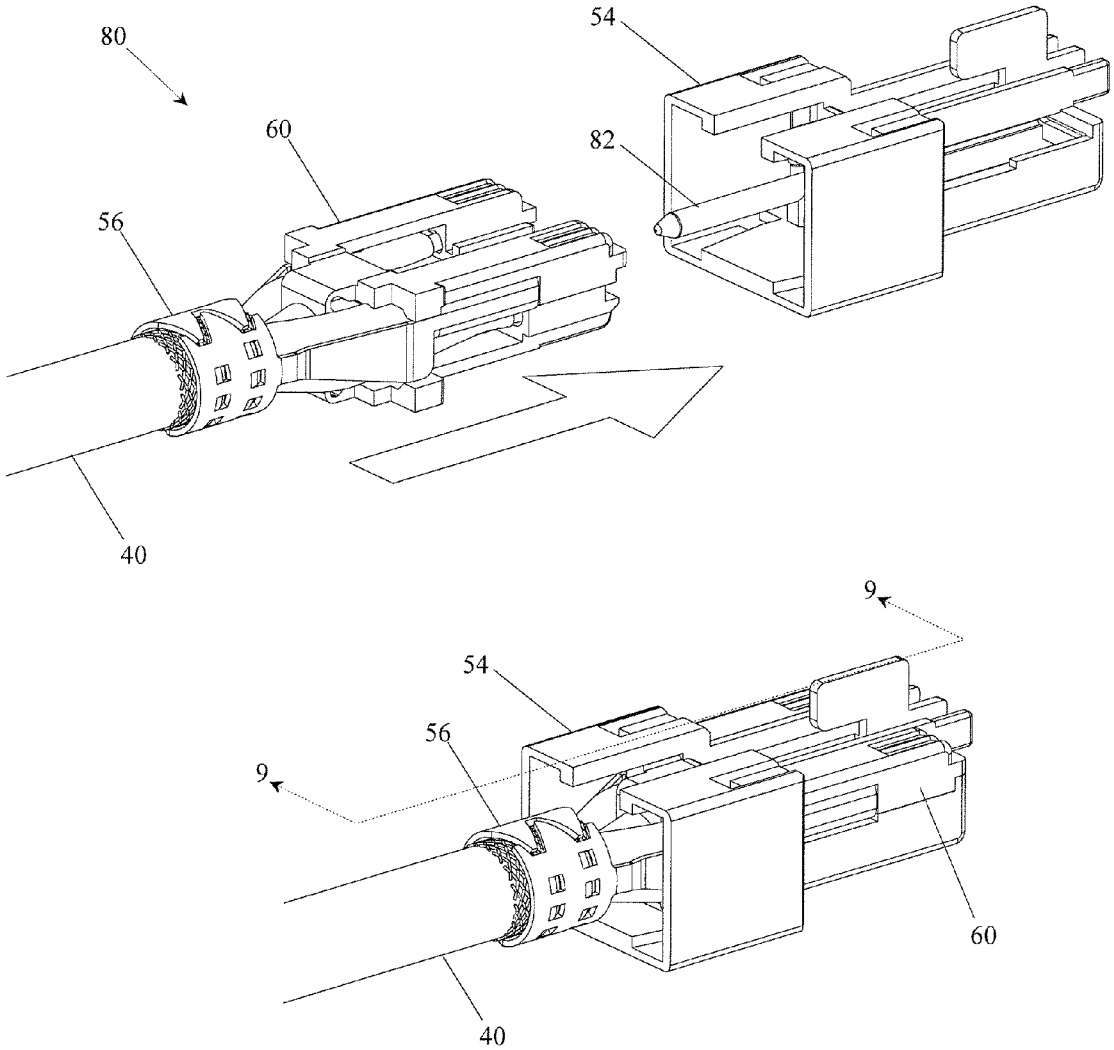
FIG. 8 are perspective views illustrating the sub-assembly of FIG. 7 being inserted into the plug housing of FIG. 2.
Figure 9:
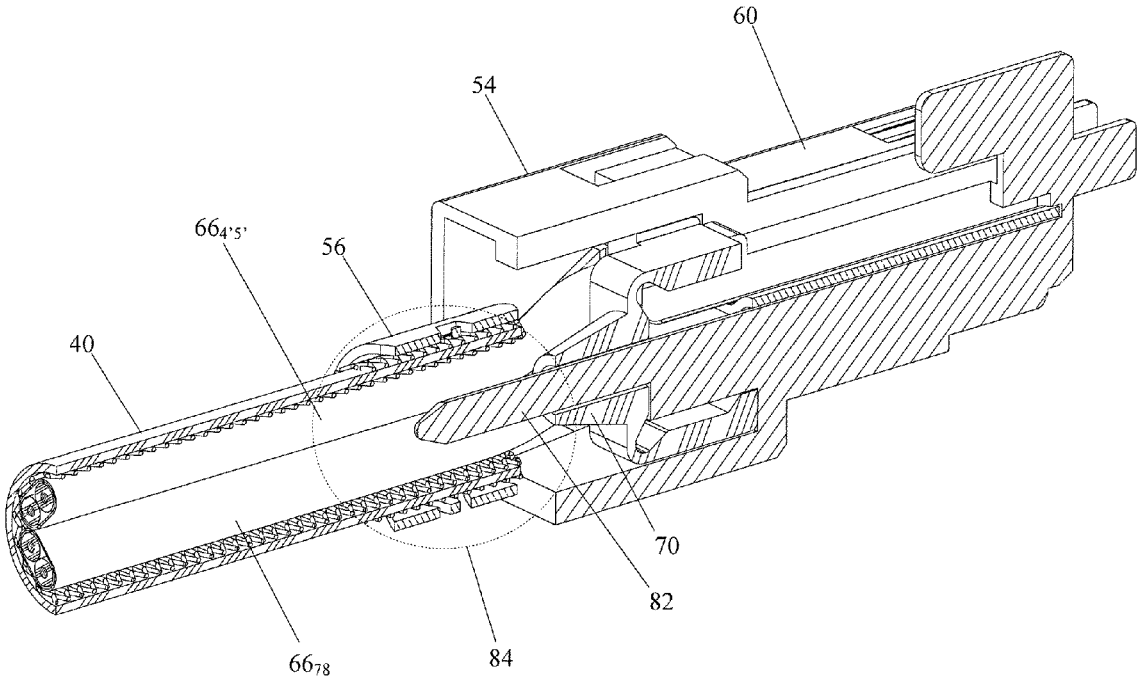
FIG. 9 is a cross-sectional view taken along section line 9-9 in FIG. 8.

Subassembly 80 is inserted into metal plug housing 54 as shown in FIG. 8. This insertion electrically bonds divider 56 to plug housing 54, resulting in a continuation of the ground throughout the assembly. Post 82 of plug housing 54 goes through conical guide element 70 of hinging load bar 60 and touches all four conductor pair foils 66 as indicated in the FIG. 9 section view. Although foil 66 makes an electrical bond with divider 56, conductive post 82 of plug housing 54 also makes an electrical bond with foil 66, creating an additional bonding region and improving the overall robustness of the design. Additionally, post 82 provides mechanical support by pushing conductor pair foils 66 outwardly and reinforcing cable 40 to create rigidity in region 84. This outward force results in a higher pressure at the interface between cable 40 and shear form barbs 76 of metal divider 56, resulting in a more effective electrical bond as well as improved mechanical strain relief.

Figure 10:
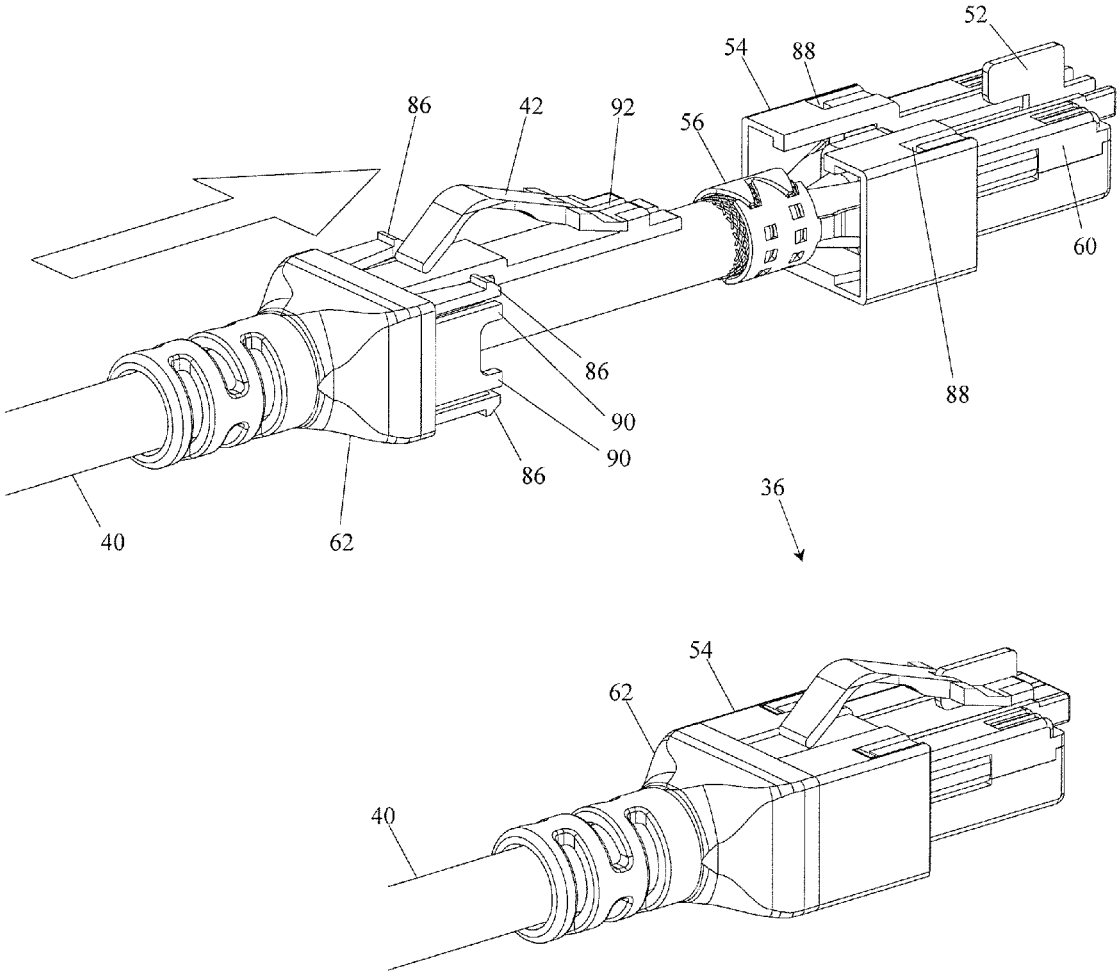
FIG. 10 are perspective views of the back housing of the plug of FIG. 2 being inserted into the sub-assembly of FIG. 8.
Figure 11:
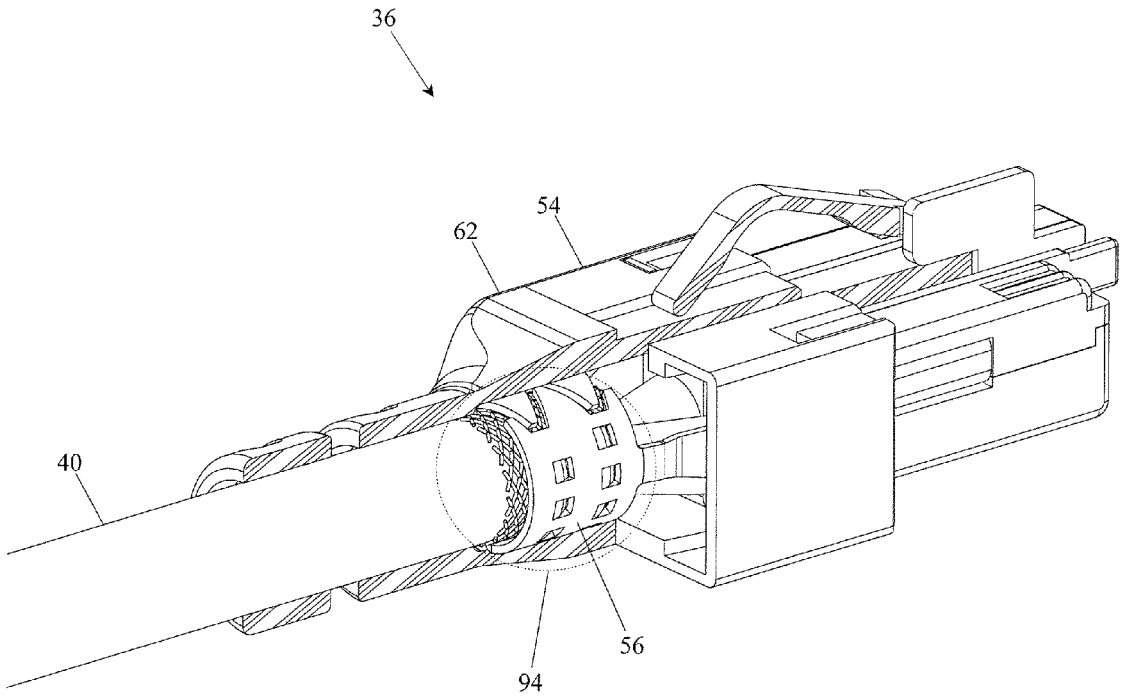
FIG. 11 is a perspective cut-away view of the GG45 plug of FIG. 2 showing the shear form barbs and overlapping flanges of the metal divider engaging the braid of the cable.

FIG. 10 shows that plastic back housing 62 then slides forward over cable 40, completing the assembly of GG45 plug 36. Four latches 86 from back housing 62 engage four pockets 88 from plug housing 54 to hold the assembly together. Rigid pads 90 from back housing 62 drive load bar 60 to the front of plug housing 54 and prevents load bar 60 from backing out. Dividing wall 52 of plug housing 54 fits within slot 92 of back housing 62. Dividing wall 52 also constrains release latch 42 and prevents it from buckling or moving out of position. When fully assembled, back housing 62 applies uniform compression to rear region 94 of divider 56 as shown in FIG. 11. The inward pressure from back housing 62, coupled with the outward pressure from post 82 of plug housing 54, creates a pressured interface between divider 56 and cable 40 resulting in a reliable electrical bond as well as the necessary mechanical strain relief.

Although communication system 30 is illustrated a patch panel in FIG. 1, alternatively it can be other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers and other peripherals as can be found in workstation areas. Communication system 30 can further include cabinets, racks, cable management and overhead routing systems, and other such equipment. Cables 34 can be used in a variety of structured cabling applications including patch cords, zone cords, backbone cabling, and horizontal cabling, although the present invention is not limited to such applications. In general, the present invention can be used in military, industrial, telecommunications, computer, data communications, marine and other cabling applications.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A communication plug for connection to a communication cable, comprising:

a load bar for connection to conductors of the communication cable, said load bar including a first half with first conductor receiving apertures and a first plurality of plug contacts each for making contact with respective one said conductor, a second half with second conductor receiving apertures and a second plurality of plug contacts each for making contact with respective one said conductor, and a hinge connecting said first half and said second half, said first half and said second half foldable toward the conductors when said plug is connected to the communication cable.

2. The communication plug of claim 1, further including a guide on said hinge wherein said guide aids in positioning of said load bar relative to said communication cable.

3. The communication plug of claim 1, further including a housing for mating with a communication jack, said housing connected to said load bar.

4. The communication plug of claim 3, wherein said housing includes a post for contacting the conductors.

5. The communication plug of claim 4, further including a guide on said hinge, wherein said post is insertable in said guide.

6. The communication plug of claim 1, further including a conductor divider between said first half and said second half.

7. The communication plug of claim 6, wherein said conductor divider includes a collar for connecting to a shield of the communication cable.

8. A communication cord, comprising:

a communication cable; and a communication plug connected to said communication cable, said communication plug including a load bar for connection to conductors of the communication cable, said load bar including a first half with first conductor receiving apertures and a first plurality of plug contacts each for making contact with respective one said conductor, a second half with second conductor receiving apertures and a second plurality of plug contacts each for making contact with respective one said conductor, and a hinge connecting said first half and said second half, said first half and said second half foldable toward the conductors when said plug is connected to the communication cable.

9. The communication cord of claim 8, further including a guide on said hinge wherein said guide aids in positioning of said load bar relative to said communication cable.

10. The communication cord of claim 8, further including a housing for mating with a communication jack, said housing connected to said load bar.

11. The communication cord of claim 10, wherein said housing includes a post for contacting the conductors.

12. The communication cord of claim 11, further including a guide on said hinge, wherein said post is insertable in said guide.

13. The communication cord of claim 8, further including a conductor divider between said first half and said second half.

14. The communication cord of claim 13, wherein said conductor divider includes a collar for connecting to a shield of the communication cable.

15. A method of connecting a shielded communication plug to a shielded communication cable, said method comprising the steps of:

separating a plurality of conductors of the communication cable around a hinge in a folding load bar;

inserting the plurality of conductors into respective conductor apertures in a first half and a second half of the load bar;

providing a respective plug contact for each of said conductors, each of said plug contact being positioned in said first half or said second half of the load bar;

collapsing the load bar over a conductor divider; and providing an electrical bond between each of said plug contacts and respective cores of respective said conductors.

16. The method of claim 15, further including the step of crimping a collar of the conductor divider onto the cable.

17. The method of claim 15, further including the step of placing a plug housing at least partially over the load bar.

18. The method of claim 17, wherein said placing step includes the substep of contacting the conductors with a post of said plug housing.

19. A shielded communication plug for connection to conductors and a shield of a shielded communication cable, comprising:

a plug housing including contacts for connection to the conductors; and a conductive divider connected to said plug housing, said conductive divider including a conductor separator connected to a braid clasp, said braid clasp for connecting to the shield, said conductor divider separating the conductors into a first subset of conductors and a second subset of conductors.

20. The shielded communication plug of claim 19, further including a load bar having first conductor receiving apertures, second conductor receiving apertures, said first conductor receiving apertures and said second conductor receiving apertures foldable toward the conductor separator.

21. A communication plug for connection to a communication cable, comprising:

a load bar for connection to conductors of the communication cable, said load bar including a first half with first conductor receiving apertures, a second half with second conductor receiving apertures, a hinge connecting said first half and said second half, said first half and said second half foldable toward the conductors when said plug is connected to the communication cable, and a guide on said hinge wherein said guide aids in positioning of said load bar relative to said communication cable by at least one of guiding said conductors around said hinge and guiding said load bar towards a center of said communication cable.

22. The communication plug of claim 21, wherein said guide comprises a cone-shaped protrusion, said cone-shaped protrusion tapering inward as it extends away from said hinge towards a cable-receiving end of said communication plug.

23. The communication plug of claim 21, further comprising a housing for mating with a communication jack, said housing being positioned at least partially over said load bar and including a longitudinally extending post for extending through an aperture within said guide and making contact with at least some of said conductors within said communication cable.

24. The communication plug of claim 23, further comprising a conductive divider between said first half and said second half, said conductor divider including a collar for connecting to said communication cable, said collar being positioned at least partially over said post.

* * * * *